US012274377B2

(12) United States Patent
Tamburro et al.

(10) Patent No.: US 12,274,377 B2
(45) Date of Patent: Apr. 15, 2025

(54) DIAPER CHANGING TABLE ASSEMBLY AND METHOD OF USE

(71) Applicants: Cheri Tamburro, Kent City, MI (US); Joseph Tamburro, Kent City, MI (US)

(72) Inventors: Cheri Tamburro, Kent City, MI (US); Joseph Tamburro, Kent City, MI (US)

( * ) Notice: Subject to any disclaimer, the term of this patent is extended or adjusted under 35 U.S.C. 154(b) by 220 days.

(21) Appl. No.: 18/110,161

(22) Filed: Feb. 15, 2023

(65) Prior Publication Data

US 2024/0268568 A1 Aug. 15, 2024

(51) Int. Cl.

| | |
|---|---|
| ***A47D 5/00*** | (2006.01) |
| ***A47C 17/64*** | (2006.01) |
| ***A47C 17/72*** | (2006.01) |
| ***A47C 17/82*** | (2006.01) |
| ***A47C 19/12*** | (2006.01) |
| ***A47C 19/14*** | (2006.01) |

(52) U.S. Cl.

CPC ..... *A47D 5/006* (2013.01); *A47C 17/645* (2013.01); *A47C 17/72* (2013.01); *A47C 17/82* (2013.01); *A47D 5/00* (2013.01); *A47C 17/64* (2013.01); *A47C 19/12* (2013.01); *A47C 19/14* (2013.01)

(58) Field of Classification Search

CPC . A47D 5/006; A47D 5/00; A47D 7/00; A47D 7/002; A47D 7/005; A47D 7/01; A47D 9/00; A47D 9/005; A47C 17/64; A47C 17/645; A47C 17/66; A47C 17/68; A47C 17/72; A47C 17/82; A47C 19/12; A47C 19/126; A47C 19/14

USPC ..... 5/655, 652, 110–112, 114–116

See application file for complete search history.

(56) References Cited

U.S. PATENT DOCUMENTS

| | | | | |
|---|---|---|---|---|
| 228,920 | A * | 6/1880 | Murray et al. | A47C 19/14 5/115 |
| 1,185,568 | A * | 5/1916 | Zeunert | A47B 3/00 5/115 |
| 2,645,540 | A * | 7/1953 | Trimble et al. | A47D 5/00 5/186.1 |
| 3,965,502 | A * | 6/1976 | Bertram | A47C 19/005 5/114 |
| D287,318 | S | 12/1986 | Garduno | |
| 4,846,204 | A * | 7/1989 | Sok Kyu | E04H 15/50 52/109 |
| 6,378,445 | B1 | 4/2002 | Willard, Sr. | |

(Continued)

FOREIGN PATENT DOCUMENTS

| | | |
|---|---|---|
| WO | WO2020163651 | 8/2020 |

*Primary Examiner* — Robert G Santos

(57) ABSTRACT

A diaper changing table assembly for elevating and supporting a user requiring a diaper change includes a frame, which comprises a plurality of linear elements. The linear elements are mutually pivotally attached so that the frame is reversibly positionable in a stowed configuration and a deployed configuration. In the stowed configuration, the linear elements are substantially parallel and proximally positioned. In the deployed configuration, the frame is substantially cuboid. A top panel, which is resiliently flexible, is attached to an upper limit of the frame. The top panel is substantially compacted and substantially planar with the frame in the stowed configuration and the deployed configuration, respectively. The frame is deployable upon a substantially horizontal surface so that the top panel is substantially horizontally positioned. The top panel thus can support a user who requires a diaper change.

15 Claims, 13 Drawing Sheets

(56) References Cited

U.S. PATENT DOCUMENTS

| | | | | |
|---|---|---|---|---|
| 6,564,402 | B1 * | 5/2003 | Lin | A47C 17/645 5/115 |
| 6,581,228 | B1 * | 6/2003 | Boskovich | A47D 5/006 5/503.1 |
| 6,644,329 | B2 * | 11/2003 | Tomason | E04H 15/02 135/96 |
| 6,763,534 | B2 | 7/2004 | Hwang | |
| 6,925,664 | B1 * | 8/2005 | Twigg | A01K 1/034 5/112 |
| 7,100,221 | B1 * | 9/2006 | Twigg | A01K 1/034 5/112 |
| 7,681,267 | B1 | 3/2010 | Hall | |
| 7,698,756 | B1 * | 4/2010 | Chen | A47C 17/72 135/96 |
| 10,111,536 | B2 | 10/2018 | Bezuidenhout | |
| 10,334,962 | B2 | 7/2019 | Hornor | |
| 10,426,573 | B2 | 10/2019 | Gauvin | |
| 2003/0024560 | A1 * | 2/2003 | Tomason | E04H 15/02 135/117 |
| 2018/0168363 | A1 * | 6/2018 | Bezuidenhout | A47D 5/006 |
| 2020/0245781 | A1 | 8/2020 | Palacios | |
| 2024/0268568 | A1 * | 8/2024 | Tamburro | A47D 5/006 |

* cited by examiner

DIAPER CHANGING TABLE ASSEMBLY AND METHOD OF USE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to changing tables and more particularly pertains to a new changing table for elevating and supporting a user requiring a diaper change. The present invention discloses a changing table that is highly portable and readily deployable, thereby facilitating changing of a diaper in a variety of circumstances and locations.

(2) Description of Related Art Including Information Disclosed Under 37 CFR 1.97 and 1.98

The prior art relates to changing tables, which may comprise rigid panels or framed flexible panels with folding frames. Related prior art includes deployable cots, which may comprise folding frames that provide cantilevered support to opposed ends of a flexible panel. What is lacking in the prior art is a changing table comprising a flexible panel to which is attached a selectively deployable frame.

BRIEF SUMMARY OF THE INVENTION

An embodiment of the disclosure meets the needs presented above by generally comprising a frame, which comprises a plurality of linear elements. The linear elements are mutually pivotally attached so that the frame is reversibly positionable in a stowed configuration and a deployed configuration. In the stowed configuration, the linear elements are substantially parallel and proximally positioned. In the deployed configuration, the frame is substantially cuboid. A top panel, which is resiliently flexible, is attached to an upper limit of the frame. The top panel is substantially compacted and substantially planar with the frame in the stowed configuration and the deployed configuration, respectively. The frame is configured for deployment upon a substantially horizontal surface so that the top panel is substantially horizontally positioned. The top panel thus is configured to support a user who requires a diaper change.

Another embodiment of the disclosure includes a method of changing a diaper. Provision steps of the method are providing a diaper and providing a diaper changing table assembly, according to the disclosure above. An operational step of the method is positioning the frame in the deployed configuration upon a substantially horizontal surface so that the top panel is substantially horizontally positioned. Use steps of the method are positioning a user requiring a diaper change upon the top panel and changing the diaper of the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
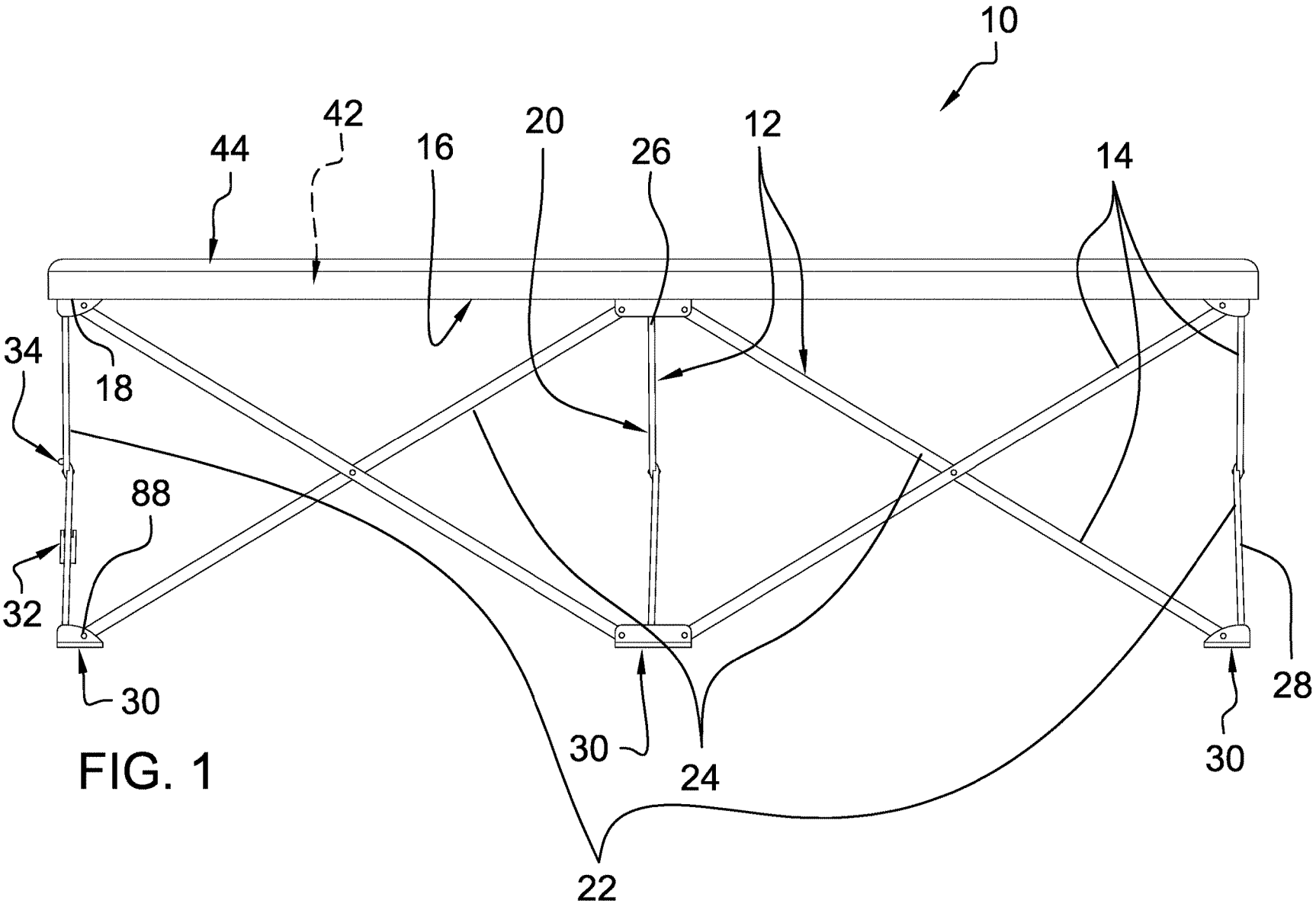
FIG. 1 is a front view of a diaper changing table assembly according to an embodiment of the disclosure.
Figure 2:
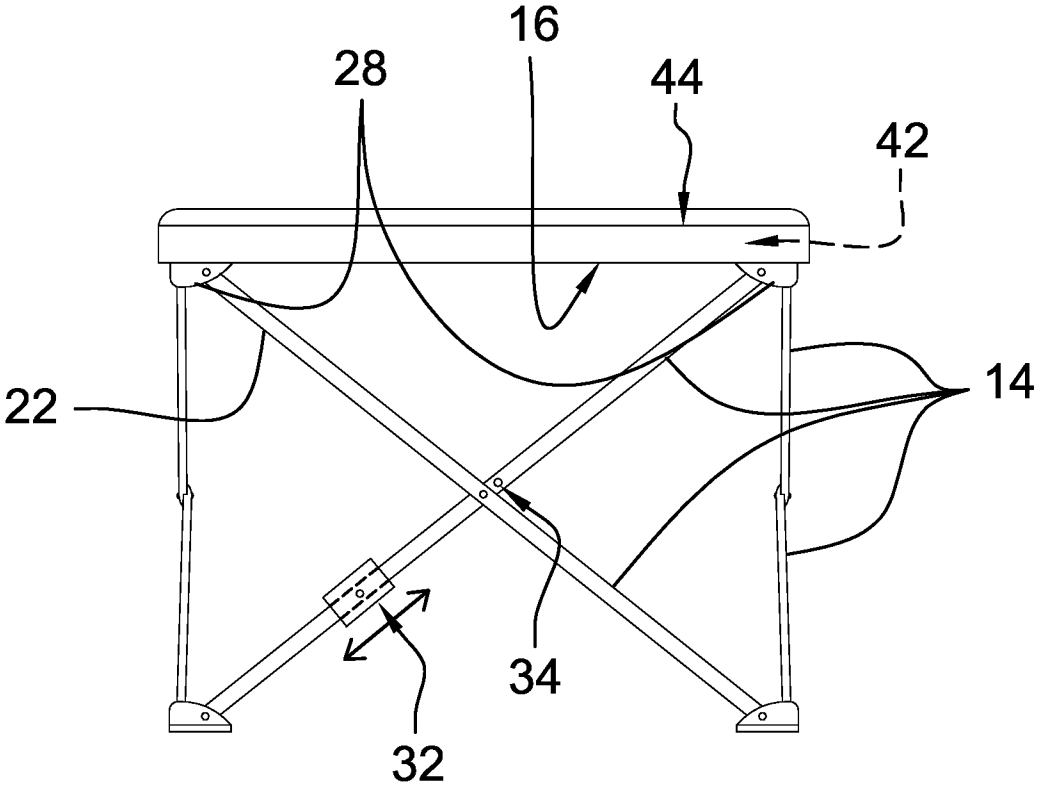
FIG. 2 is an end view of an embodiment of the disclosure.
Figure 3:
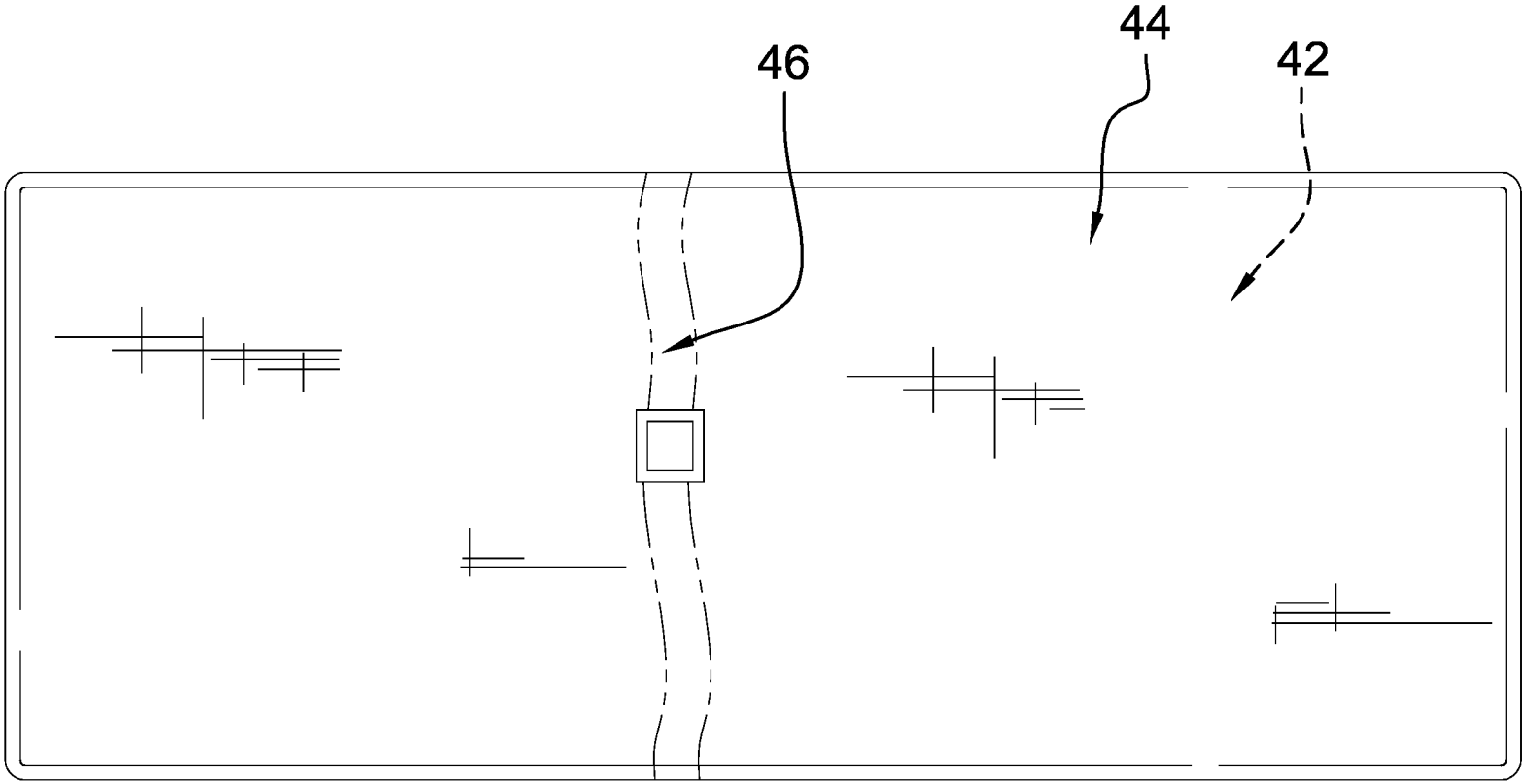
FIG. 3 is a top view of an embodiment of the disclosure.
Figure 4:
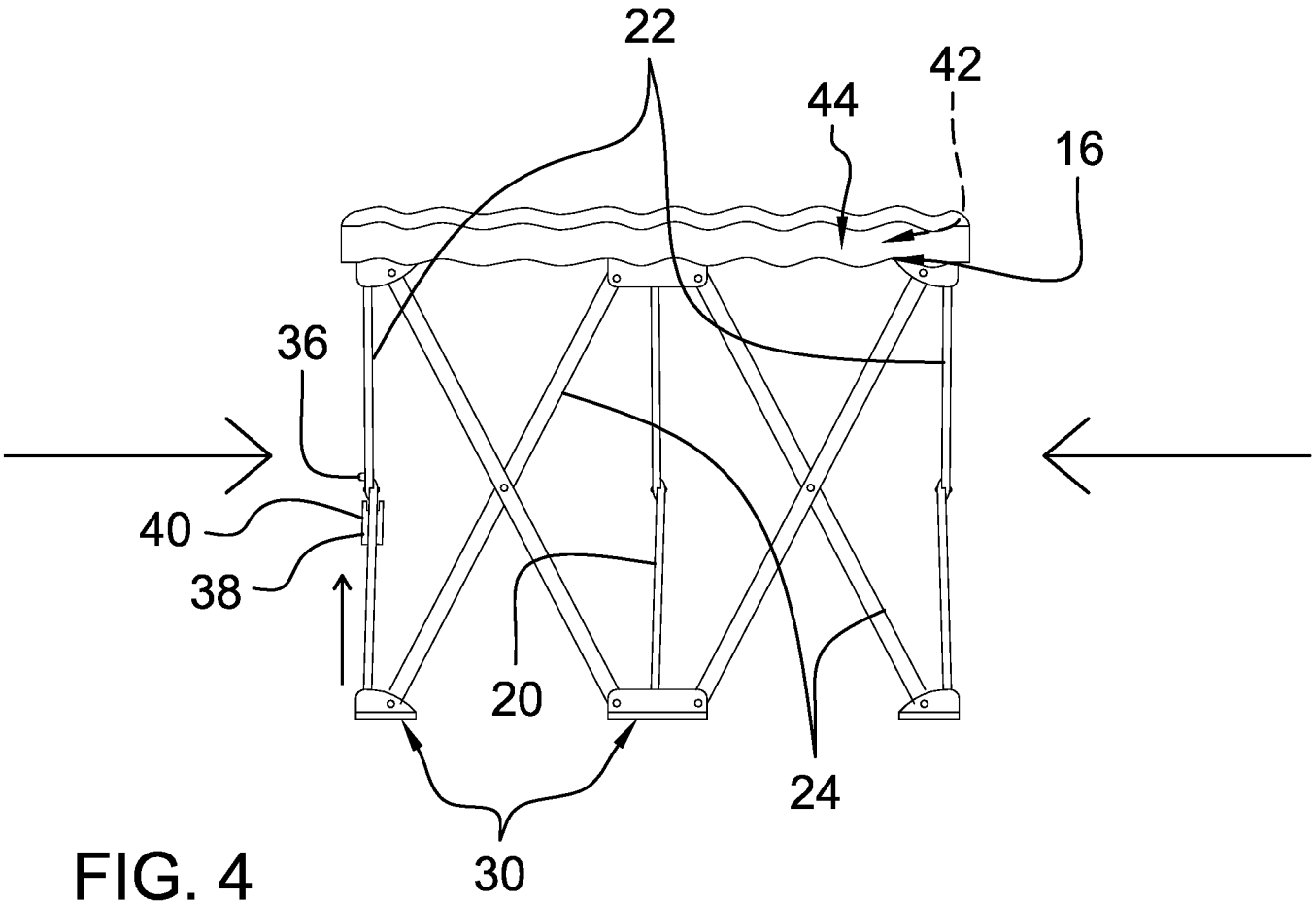
FIG. 4 is a front view of an embodiment of the disclosure.

With reference now to the drawings, and in particular to FIGS. 1 through 14 thereof, a new changing table embodying the principles and concepts of an embodiment of the disclosure and generally designated by the reference numeral 10 will be described.

As best illustrated in FIGS. 1 through 14, the diaper changing table assembly 10 generally comprises a frame 12, which comprises a plurality of linear elements 14. The linear elements 14 are mutually pivotally attached so that the frame 12 is reversibly positionable in a stowed configuration and a deployed configuration. In the stowed configuration, as shown in FIG. 6, the linear elements 14 are substantially parallel and proximally positioned. In the deployed configuration, as shown in FIG. 1, the frame 12 is substantially cuboid. A top panel 16, which is resiliently flexible, is attached to an upper limit 18 of the frame 12. The top panel 16 is substantially compacted and substantially planar with the frame 12 in the stowed configuration and the deployed configuration, respectively.

The frame 12 is configured for deployment upon a substantially horizontal surface so that the top panel 16 is substantially horizontally positioned. The top panel 16 thus is configured to support a user who requires a diaper change. The present invention is anticipated to be useful in assisting a diaper change by elevating the user for easier manipulation. The diaper changing table assembly 10 can be of various sizes and can be constructed to handle various weights of users, such as infants, children, and adults.

The frame 12 comprises a center member 20, a pair of end members 22, and a set of side members 24, each of which comprises two linear elements 14 that are mutually pivotally attached. Thus, each of the center member 20, the end members 22, and the side members 24 is X shaped when the frame 12 is in the deployed configuration. Each side member 24 is hingedly attached to and extends between a respective opposed side 26 of the center member 20 and a respective opposing side 28 of a respective end member 22. A plurality of feet 30 is hingedly attached to a lower limit 88 of the frame 12. The feet 30, which comprise rubber, silicone, elastomer, or the like, are resiliently compressible. The feet 30 are configured to limit sliding of the frame 12 upon the substantially horizontal surface.

A first fastener 32 is attached to one of the linear elements 14 that comprises a respective one of the end members 22. A second fastener 34 is attached to the other of the linear elements 14 that comprises the respective one of the end members 22. The second fastener 34 is complementary to the first fastener 32 and thus is positioned to selectively engage the first fastener 32, with the frame 12 in the deployed configuration, to removably secure the frame 12 in the deployed configuration. The second fastener 34 may comprise a pin 36, which is spring loaded. The first fastener 32 may comprise a sleeve 38, which is slidably attached to the one of linear elements 14 so that the pin 36 is positioned for insertion into a hole 40 that is positioned in the sleeve 38 to removably secure the frame 12 in the deployed configuration.

The diaper changing table assembly 10 also may comprise a pad 42, a sheet 44, and a safety belt 46. The pad 42 is attached to the top panel 16 and is positioned between the top panel 16 and the user. The pad 42 thus is configured to cushion the user. The sheet 44 is selectively attachable to the pad 42 and covers the pad 42, with the sheet 44 being positioned between the pad 42 and the user. The sheet 44 comprises elastomer and thus is substantially impermeable to water. The sheet 44 is configured to protect the pad 42 from being soiled during the diaper change. The safety belt 46 is attached to the frame 12 and is configured to removably secure the user in position upon the top panel 16.

Figure 9:
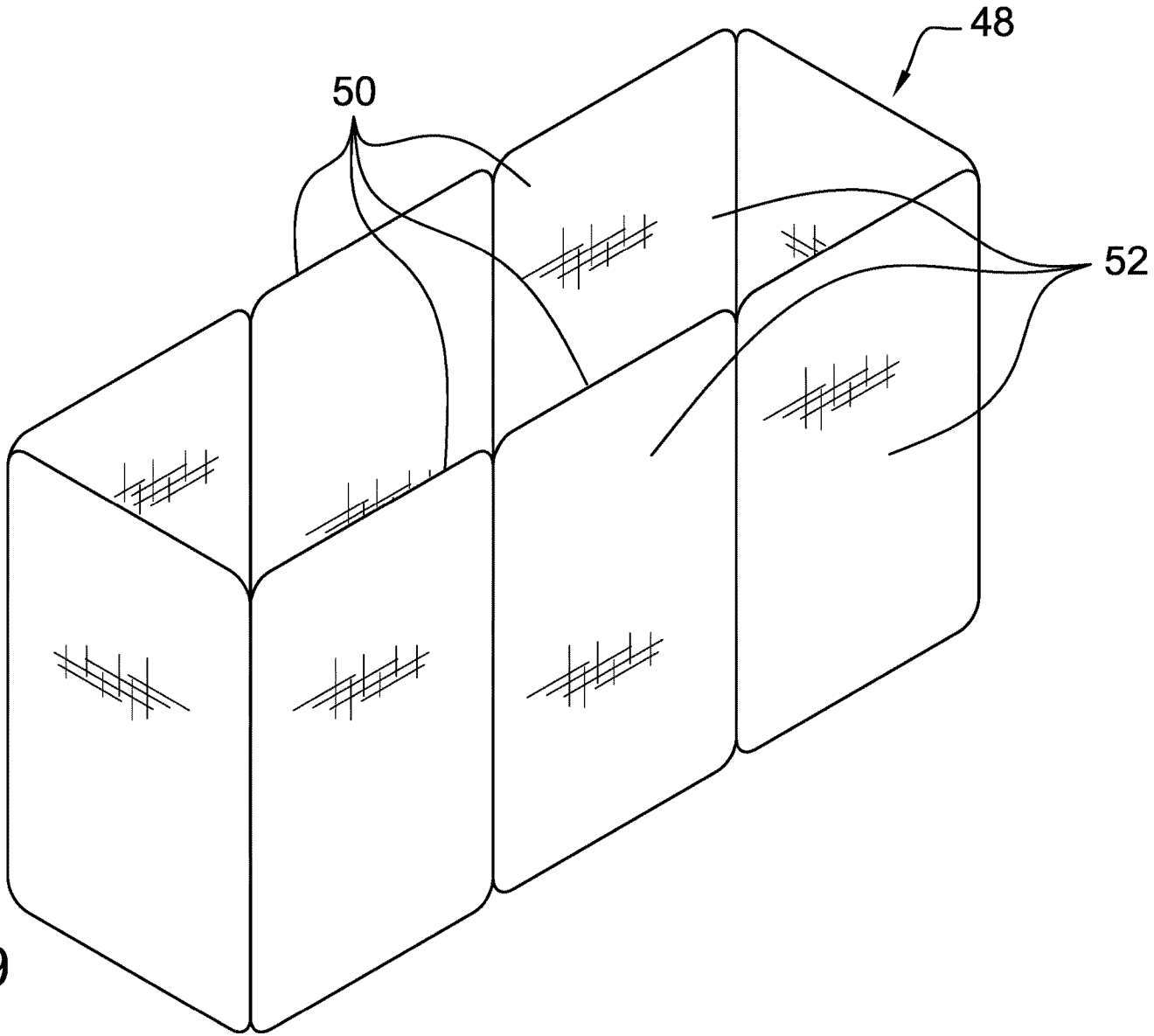
FIG. 9 is an in-use view of an embodiment of the disclosure.
Figure 10:
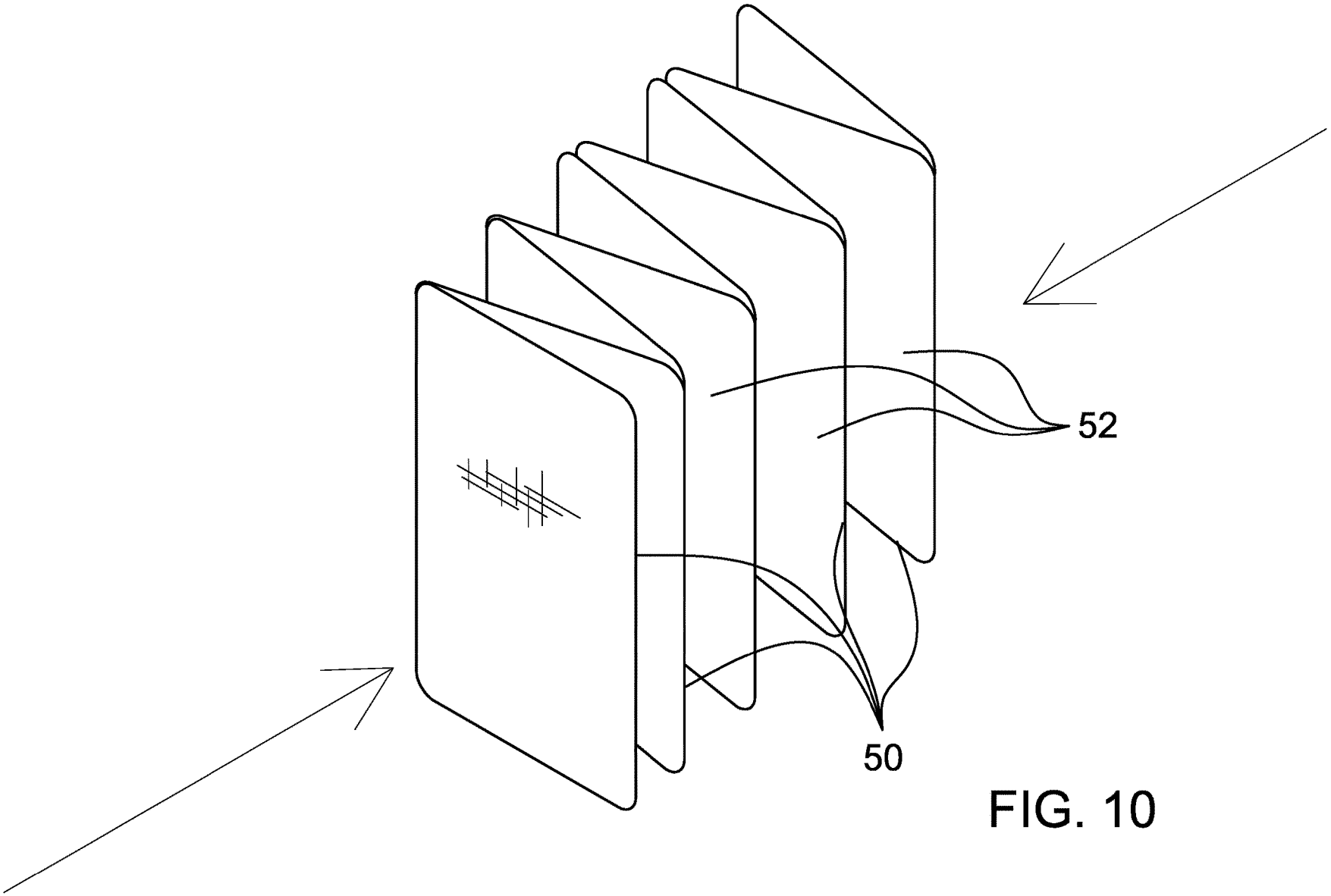
FIG. 10 is an in-use view of an embodiment of the disclosure.
Figure 12:
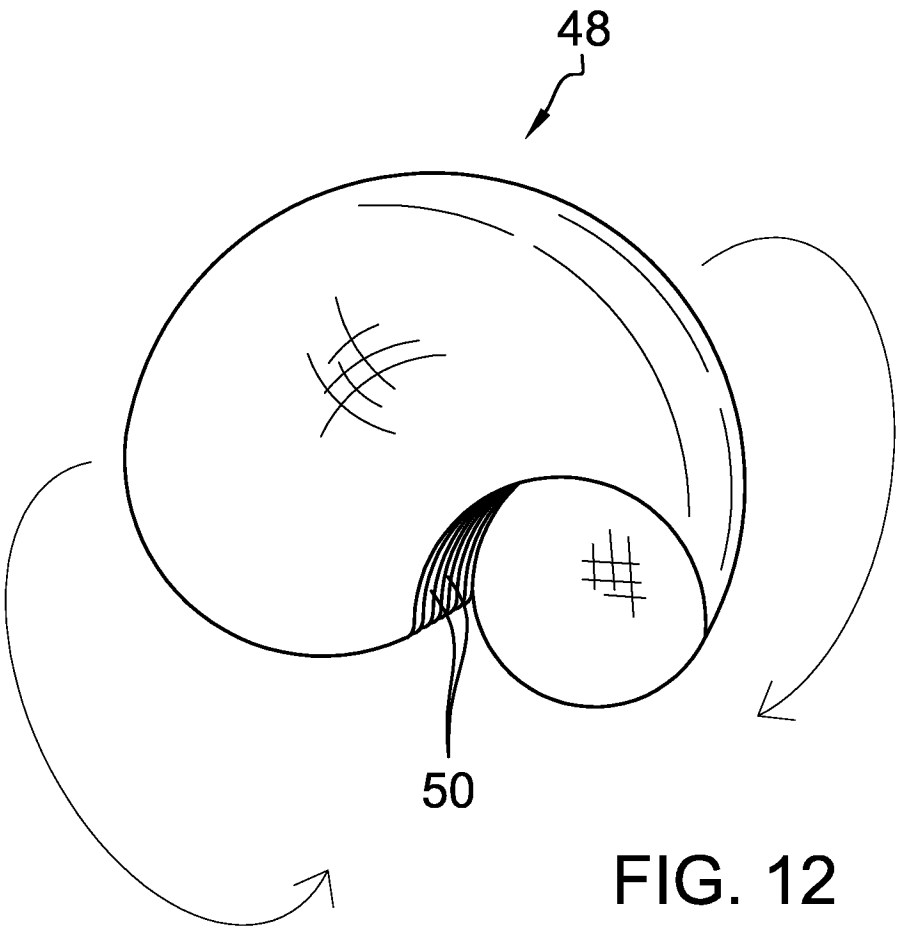
FIG. 12 is an in-use view of an embodiment of the disclosure.
Figure 11:
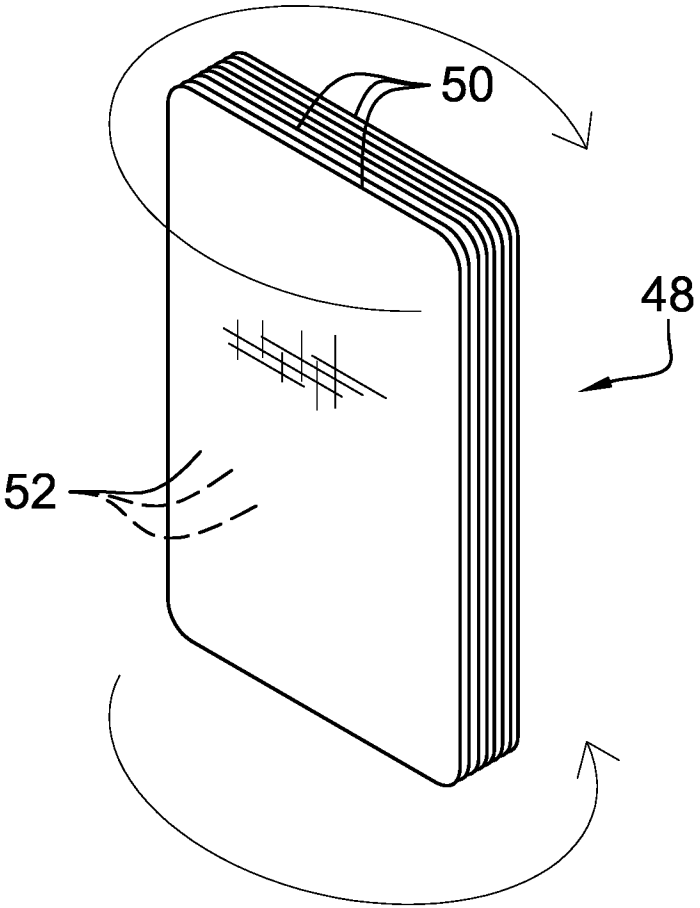
FIG. 11 is an in-use view of an embodiment of the disclosure.
Figure 13:
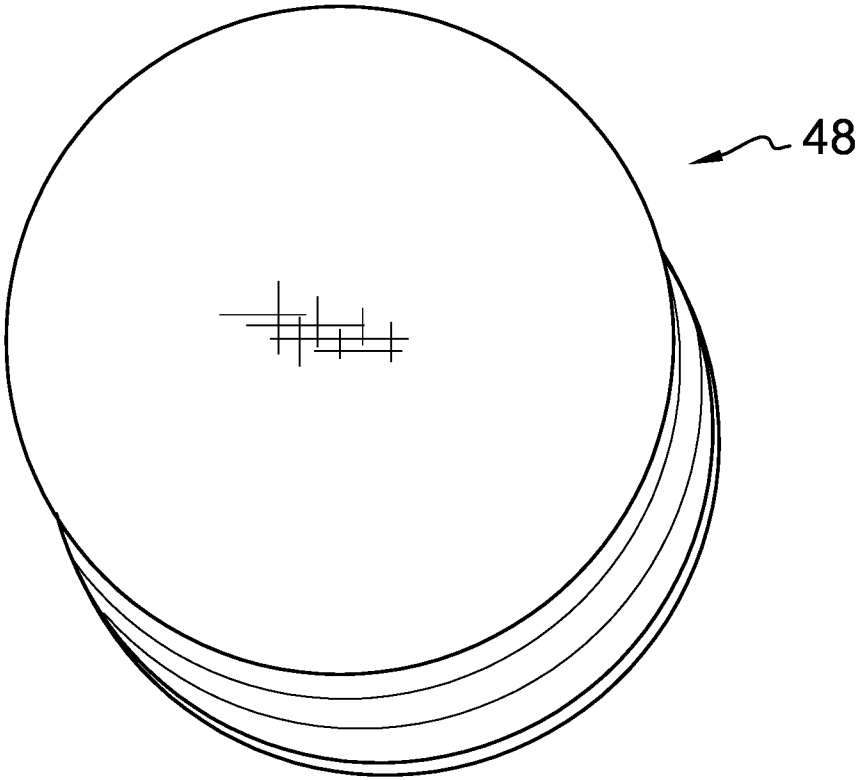
FIG. 13 is an in-use view of an embodiment of the disclosure.
Figure 14:
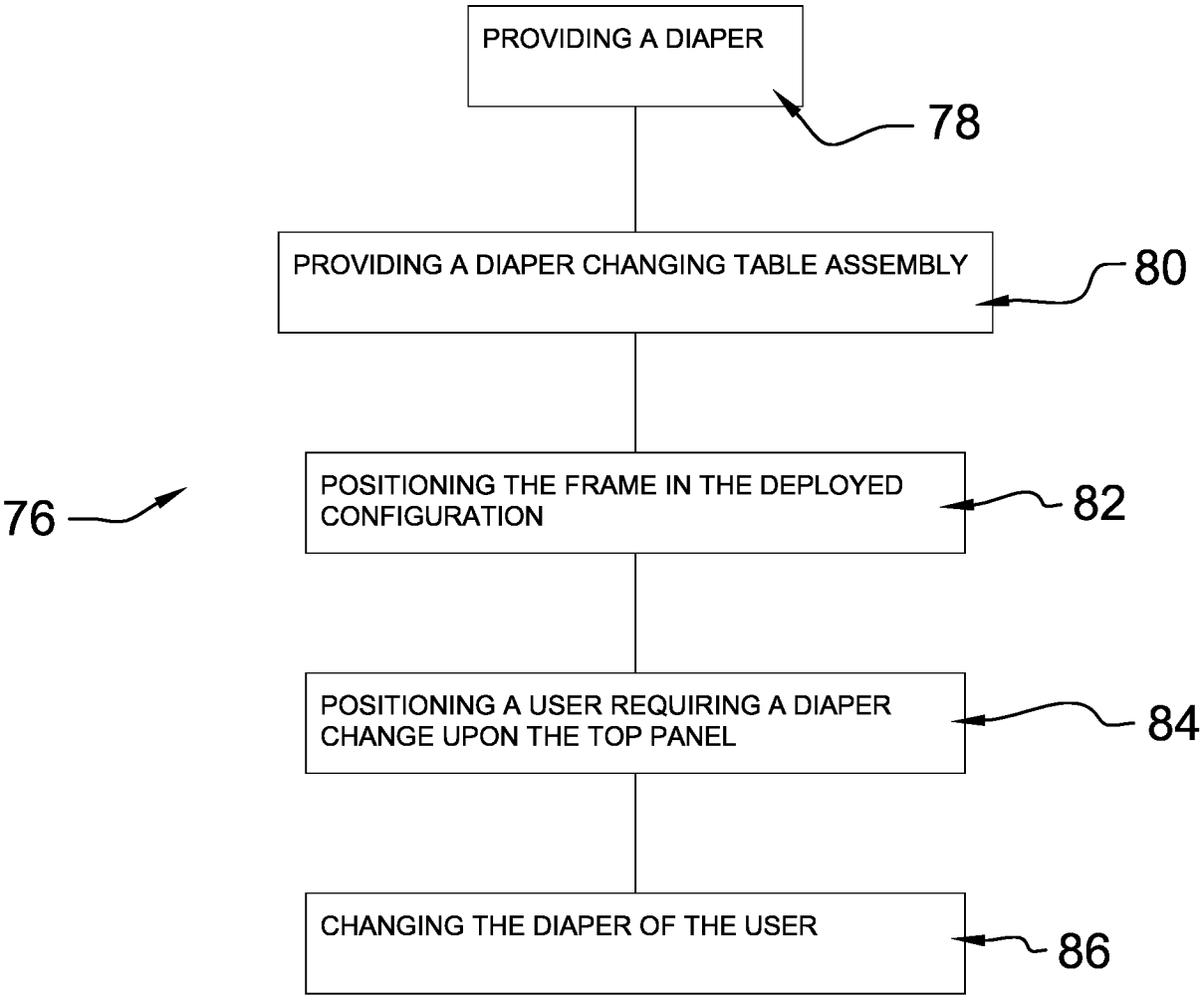
FIG. 14 is a flow diagram for a method utilizing an embodiment of the disclosure.

The diaper changing table assembly 10 also may comprise a screen 48, as shown in FIG. 9, which is configured to be deployed around the frame 12. The screen 48 is configured to shield the user from view of passersby during the diaper change. The screen 48 comprises a plurality of endless rods 50 and a plurality of flexible panels 52. Each flexible panel 52 is attached to a respective endless rod 50. The endless rods 50 are mutually hingedly attached and thus are selectively positionable in a folded configuration, as is demonstrated in FIG. 10, wherein the endless rods 50 are substantially parallel planarly positioned and in substantial abutment, and an extended configuration, as shown in FIG. 9, wherein the endless rods 50 can be positioned to surround the frame 12. The endless rods 50 comprise resiliently bendable wire so that the plurality of endless rods 50 are reversibly twistable when in the folded configuration, as shown in FIG. 11, and foldable, as shown in FIG. 12, into a compacted configuration.

Figure 5:
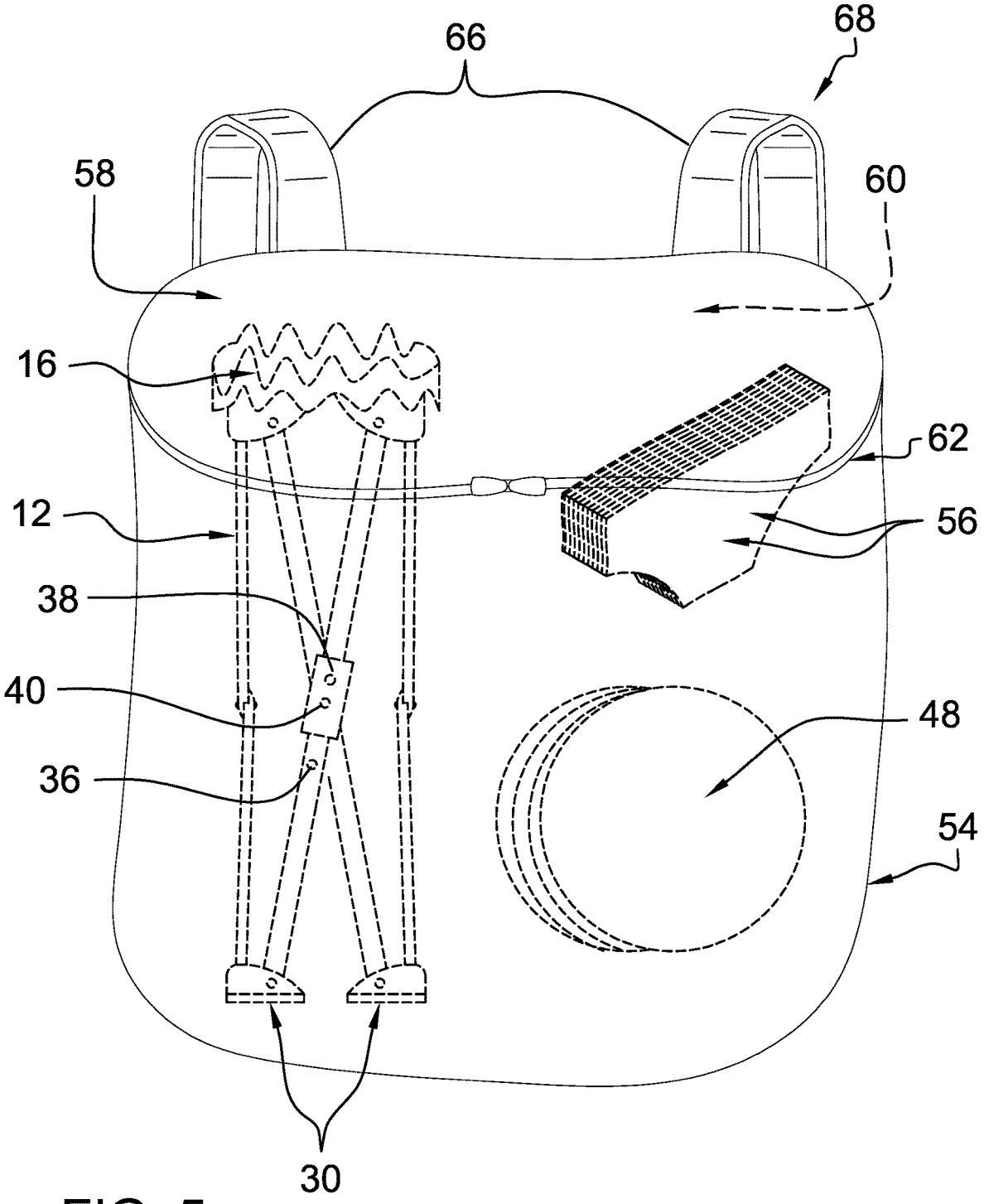
FIG. 5 is a front view of an embodiment of the disclosure.
Figure 6:
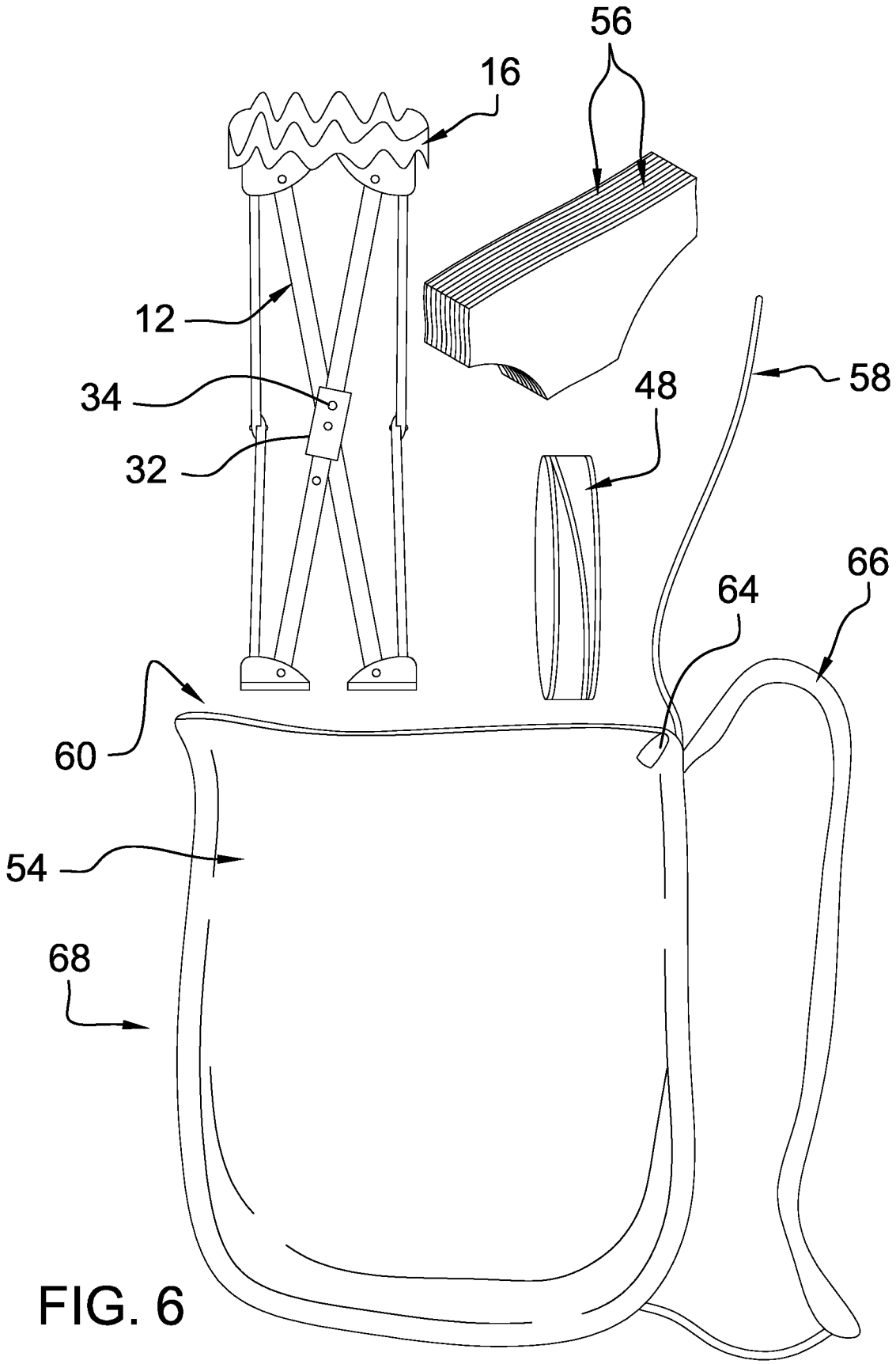
FIG. 6 is an exploded view of an embodiment of the disclosure.
Figure 7:
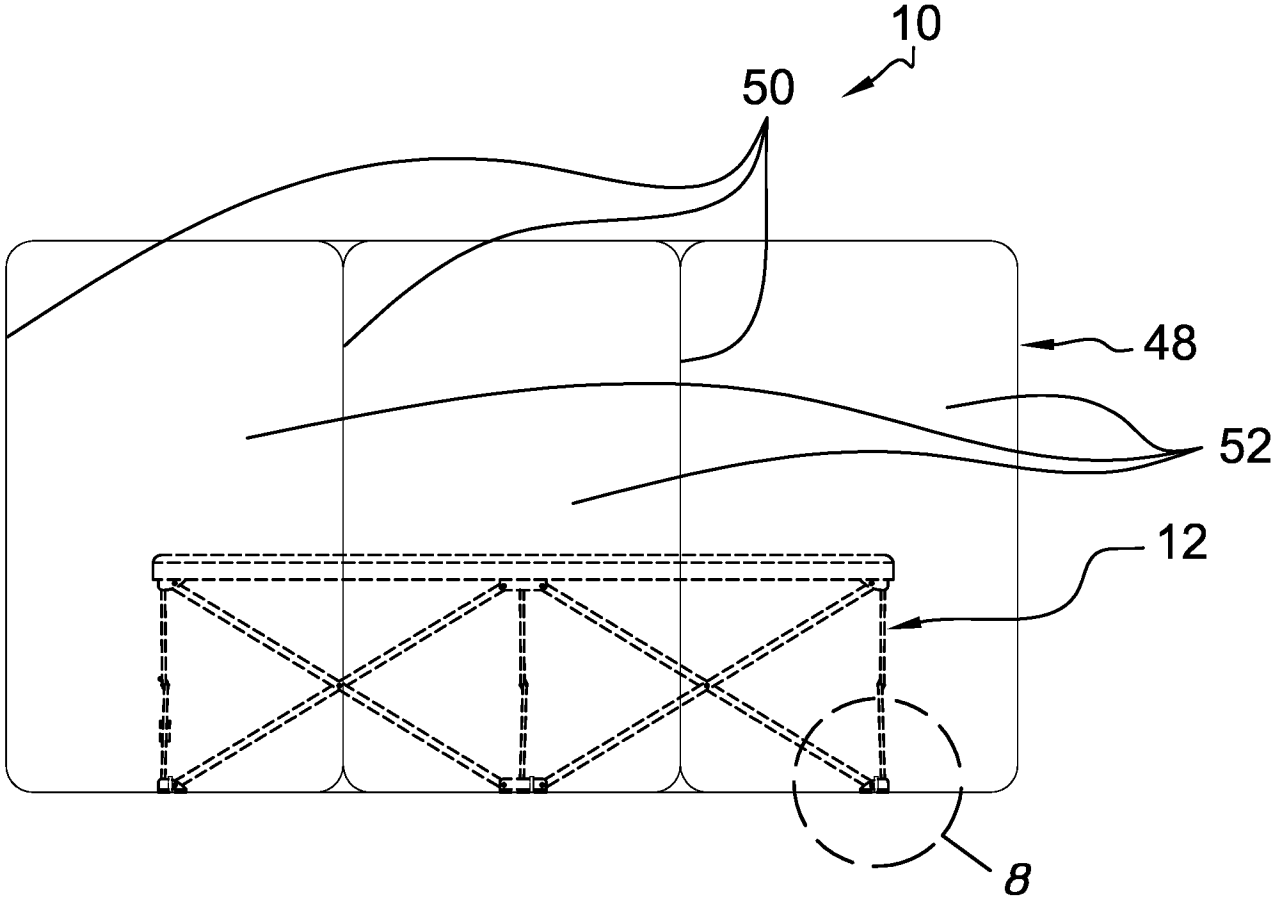
FIG. 7 is an in-use view of an embodiment of the disclosure.

As shown in FIG. 5, the diaper changing table assembly 10 also may comprise a sack 54, which is sized to contain the frame 12, with the frame 12 is in the stowed configuration, the screen 48, with the plurality of endless rods 50 are in the compacted configuration, and a plurality of diapers 56. A flap 58 is attached to the sack 54 and is positioned to selectively close an opening 60 in the sack 54. A closure 62 is attached to the sack 54 and is positioned to selectively attach to the flap 58 to reversibly secure the flap 58 over the opening 60. The closure 62 may comprise a zipper 64, or other closing means, such as, but not limited to, buttons, snaps, or the like. As shown in FIGS. 5 and 6, a pair of straps 66 may be attached to the sack 54 so that the sack 54 is configured as a backpack 68.

Figure 8:
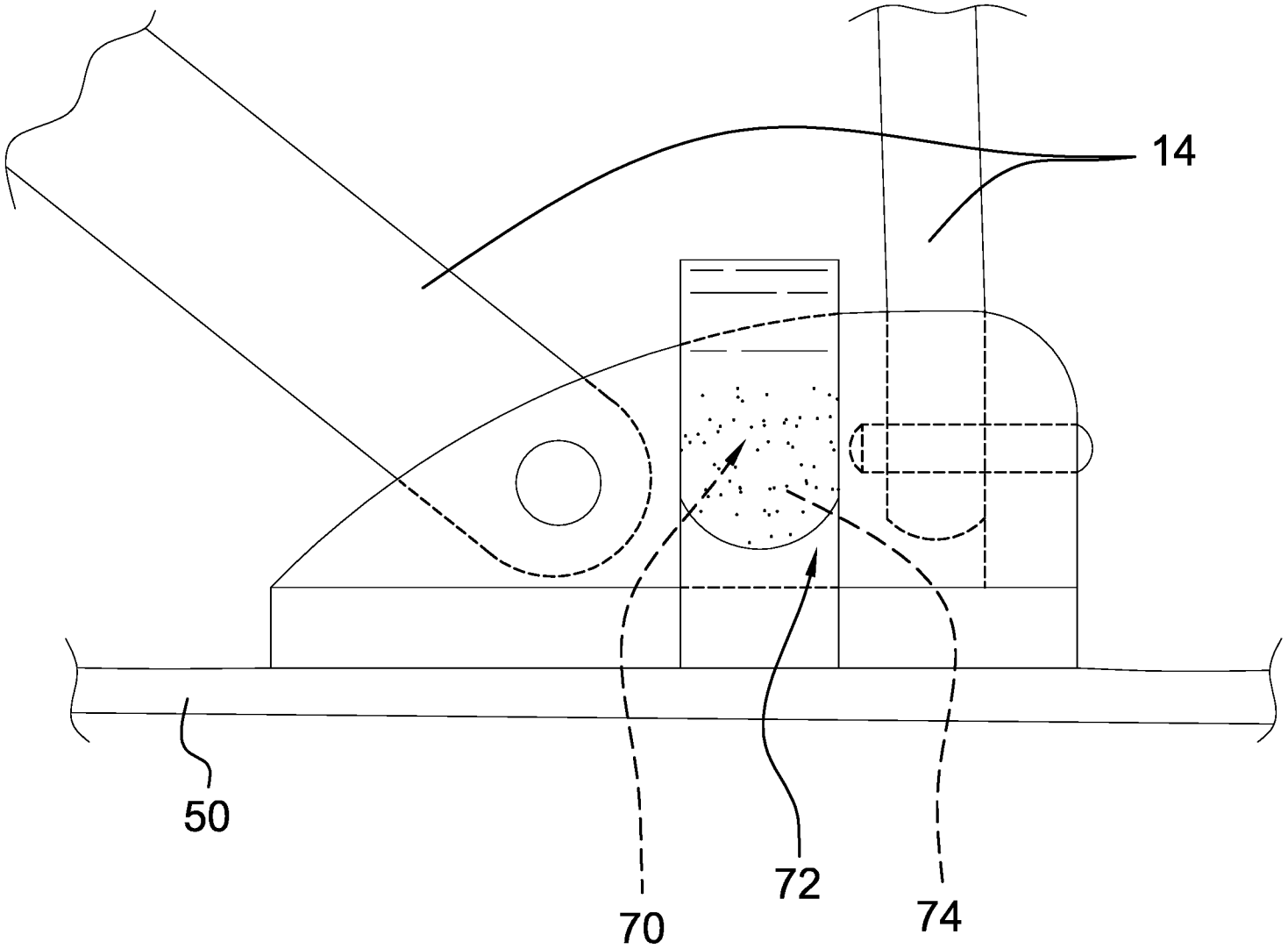
FIG. 8 is a detail view of an embodiment of the disclosure.

As shown in FIG. 8, a first coupler 70 is attached to the frame 12 and a second coupler 72 is attached to the screen 48. The second coupler 72 is complementary to the first coupler 70 and thus is positioned to selectively attach to the first coupler 70 to removably secure the screen 48 to the frame 12. The second coupler 72 and the first coupler 70 may comprise a hook and loop strap 74, or other coupling means, such as, but not limited to, bungee cords, other types of straps, or the like.

In use, the diaper changing table assembly 10 enables a method of changing a diaper 76, which comprises a first provision step 78 that entails providing a diaper 56. A second provision step 80 of the method 76 is providing a diaper changing table assembly 10, according to the specification above. An operational step 82 of the method 76 is positioning the frame 12 in the deployed configuration upon a substantially horizontal surface so that the top panel 16 is substantially horizontally positioned. A first use step 84 of the method 76 is positioning a user requiring a diaper change upon the top panel 16. A second use step 86 of the method 76 is changing the diaper 56 of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A diaper changing table assembly comprising:

a frame comprising a plurality of linear elements, the linear elements of the plurality of linear elements being mutually pivotally attached, such that the frame is reversibly positionable in a stowed configuration, wherein the linear elements of the plurality of linear elements are substantially parallel and proximally positioned, and a deployed configuration, wherein the frame is substantially cuboid;

a top panel attached to an upper limit of the frame, the top panel being resiliently flexible, such that the top panel is substantially compacted and substantially planar with the frame in the stowed configuration and the deployed configuration, respectively, wherein the frame is configured for deployment upon a substantially horizontal surface, such that the top panel is substantially horizontally positioned, wherein the top panel is configured for supporting a user requiring a diaper change; and a screen configured for deployment around the frame, wherein the screen is configured for shielding the user from view of passersby during the diaper change, wherein the screen comprises a plurality of endless rods, the endless rods of the plurality of endless rods being mutually hingedly attached, such that the endless rods of the plurality of endless rods are selectively positionable in a folded configuration, wherein the endless rods of the plurality of endless rods are substantially parallel planarly positioned and in substantial abutment, and an extended configuration, wherein the endless rods of the plurality of endless rods surround the frame, the endless rods of the plurality of endless rods comprising resiliently bendable wire, such that the plurality of endless rods, when in the folded configuration, are reversibly twistable and foldable into a compacted configuration, and a plurality of flexible panels, each flexible panel of the plurality of flexible panels being attached to a respective endless rod of the plurality of endless rods.

2. The diaper changing table assembly of claim 1, wherein the frame comprises:

a center member comprising two linear elements, the linear elements of the center member being mutually pivotally attached such that the center member is X-shaped when the frame is in the deployed configuration;

a pair of end members, each end member of the pair of end members comprising two linear elements, the linear elements being mutually pivotally attached such that the end member is X-shaped when the frame is in the deployed configuration; and a set of side members, each side member of the set of side members comprising two linear elements, the linear elements being mutually pivotally attached such that the side member is X-shaped when the frame is in the deployed configuration, each side member of the set of side members being hingedly attached to and extending between a respective opposed side of the center member and a respective opposing side of a respective end member of the pair of end members.

3. The diaper changing table assembly of claim 2, further including:

a first fastener attached to one of the linear elements comprising a respective one of the end members of the pair of end members; and a second fastener attached to the other of the linear elements comprising the respective one of the end members of the pair of end members, the second fastener being complementary to the first fastener, such that the second fastener is positioned for selectively engaging the first fastener with the frame in the deployed configuration for removably securing the frame in the deployed configuration.

4. The diaper changing table assembly of claim 1, further including a pad attached to the top panel, such that the pad is configured to be positioned between the top panel and the user, wherein the pad is configured for cushioning the user.

5. The diaper changing table assembly of claim 4, further including a sheet selectively attachable to the pad, such that the sheet covers the pad with the sheet being configured to be positioned between the pad and the user, the sheet comprising elastomer, such that the sheet is substantially impermeable to water, wherein the sheet is configured for protecting the pad from soiling during the diaper change.

6. The diaper changing table assembly of claim 2, further including a plurality of feet hingedly attached to a lower limit of the frame, the feet of the plurality of feet being resiliently compressible, wherein the feet of the plurality of feet are configured for limiting sliding of the frame upon the substantially horizontal surface.

7. The diaper changing table assembly of claim 6, wherein the feet of the plurality of feet comprises rubber, silicone, or elastomer.

8. The diaper changing table assembly of claim 1, further including a safety belt attached to the frame, wherein the safety belt is configured for removably securing the user in position upon the top panel.

9. The diaper changing table assembly of claim 1, further including:

a sack sized to contain the frame, with the frame in the stowed configuration, the screen, with the plurality of endless rods in the compacted configuration, and a plurality of diapers;

a flap attached to the sack, such that the flap is positioned for selectively closing an opening in the sack; and a closure attached to the sack and being positioned for selectively attaching to the flap for reversibly securing the flap over the opening.

10. The diaper changing table assembly of claim 9, wherein the closure comprises a zipper.

11. The diaper changing table assembly of claim 9, further including a pair of straps attached to the sack, such that the sack is configured as a backpack.

12. The diaper changing table assembly of claim 1, further including:

a first coupler attached to the frame; and a second coupler attached to the screen, the second coupler being complementary to the first coupler, such that the second coupler is positioned for selectively attaching to the first coupler for removably securing the screen to the frame.

13. The diaper changing table assembly of claim 12, wherein the second coupler and the first coupler comprise a hook and loop strap.

14. A diaper changing table assembly comprising:

a frame comprising a plurality of linear elements, the linear elements of the plurality of linear elements being mutually pivotally attached, such that the frame is reversibly positionable in a stowed configuration, wherein the linear elements of the plurality of linear elements are substantially parallel and proximally positioned, and a deployed configuration, wherein the frame is substantially cuboid;

a top panel attached to an upper limit of the frame, the top panel being resiliently flexible, such that the top panel is substantially compacted and substantially planar with the frame in the stowed configuration and the deployed configuration, respectively, wherein the frame is configured for deployment upon a substantially horizontal surface, such that the top panel is substantially horizontally positioned, wherein the top panel is configured for supporting a user requiring a diaper change;

wherein the frame comprises a center member comprising two linear elements, the linear elements of the center member being mutually pivotally attached such that the center member is X-shaped when the frame is in the deployed configuration, a pair of end members, each end member of the pair of end members comprising two linear elements, the linear elements being mutually pivotally attached such that the end member is X-shaped when the frame is in the deployed configuration, and a set of side members, each side member of the set of side members comprising two linear elements, the linear elements being mutually pivotally attached such that the side member is X-shaped when the frame is in the deployed configuration, each side member of the set of side members being hingedly attached to and extending between a respective opposed side of the center member and a respective opposing side of a respective end member of the pair of end members;

a first fastener attached to one of the linear elements comprising a respective one of the end members of the pair of end members;

a second fastener attached to the other of the linear elements comprising the respective one of the end members of the pair of end members, the second fastener being complementary to the first fastener, such that the second fastener is positioned for selectively engaging the first fastener with the frame in the deployed configuration for removably securing the frame in the deployed configuration;

wherein the second fastener comprises a pin, the pin being spring loaded; and wherein the first fastener comprises a sleeve slidably attached to the one of linear elements, such that the pin is positioned for insertion into a hole positioned in the sleeve for removably securing the frame in the deployed configuration.

15. A diaper changing table assembly comprising:

a frame comprising a plurality of linear elements, the linear elements of the plurality of linear elements being mutually pivotally attached, such that the frame is reversibly positionable in a stowed configuration, wherein the linear elements of the plurality of linear elements are substantially parallel and proximally positioned, and a deployed configuration, wherein the frame is substantially cuboid, the frame comprising:

a center member comprising two linear elements, the linear elements of the center member being mutually pivotally attached such that the center member is X-shaped when the frame is in the deployed configuration, a pair of end members, each end member of the pair of end members comprising two linear elements, the linear elements being mutually pivotally attached such that the end member is X-shaped when the frame is in the deployed configuration, and a set of side members, each side member of the set of side members comprising two linear elements, the linear elements being mutually pivotally attached such that the side member is X-shaped when the frame is in the deployed configuration, each side member of the set of side members being hingedly attached to and extending between a respective opposed side of the center member and a respective opposing side of a respective end member of the pair of end members;

a first fastener attached to one of the linear elements comprising a respective one of the end members of the pair of end members;

a second fastener attached to the other of the linear elements comprising the respective one of the end members of the pair of end members, the second fastener being complementary to the first fastener, such that the second fastener is positioned for selectively engaging the first fastener with the frame in the deployed configuration for removably securing the frame in the deployed configuration, the second fastener comprising a pin, the pin being spring loaded, the first fastener comprising a sleeve slidably attached to the one of linear elements, such that the pin is positioned for insertion into a hole positioned in the sleeve for removably securing the frame in the deployed configuration;

a top panel attached to an upper limit of the frame, the top panel being resiliently flexible, such that the top panel is substantially compacted and substantially planar with the frame in the stowed configuration and the deployed configuration, respectively, wherein the frame is configured for deployment upon a substantially horizontal surface, such that the top panel is substantially horizontally positioned, wherein the top panel is configured for supporting a user requiring a diaper change;

a pad attached to the top panel, such that the pad is configured to be positioned between the top panel and the user, wherein the pad is configured for cushioning the user;

a sheet selectively attachable to the pad, such that the sheet covers the pad with the sheet being configured to be positioned between the pad and the user, the sheet comprising elastomer, such that the sheet is substantially impermeable to water, wherein the sheet is configured for protecting the pad from soiling during the diaper change;

a plurality of feet hingedly attached to a lower limit of the frame, the feet of the plurality of feet being resiliently compressible, wherein the feet of the plurality of feet are configured for limiting sliding of the frame upon the substantially horizontal surface, the feet of the plurality of feet comprising rubber, silicone, or elastomer;

a safety belt attached to the frame, wherein the safety belt is configured for removably securing the user in position upon the top panel;

a screen configured for deployment around the frame, wherein the screen is configured for shielding the user from view of passersby during the diaper change, the screen comprising:

a plurality of endless rods, the endless rods of the plurality of endless rods being mutually hingedly attached, such that the endless rods of the plurality of endless rods are selectively positionable in a folded configuration, wherein the endless rods of the plurality of endless rods are substantially parallel planarly positioned and in substantial abutment, and an extended configuration, wherein the endless rods of the plurality of endless rods surround the frame, the endless rods of the plurality of endless rods comprising resiliently bendable wire, such that the plurality of endless rods, when in the folded configuration, are reversibly twistable and foldable into a compacted configuration, and a plurality of flexible panels, each flexible panel of the plurality of flexible panels being attached to a respective endless rod of the plurality of endless rods;

a sack sized to contain the frame, with the frame in the stowed configuration, the screen, with the plurality of endless rods in the compacted configuration, and a plurality of diapers;

a flap attached to the sack, such that the flap is positioned for selectively closing an opening in the sack;

a closure attached to the sack and being positioned for selectively attaching to the flap for reversibly securing the flap over the opening, the closure comprising a zipper;

a pair of straps attached to the sack, such that the sack is configured as a backpack;

a first coupler attached to the frame; and a second coupler attached to the screen, the second coupler being complementary to the first coupler, such that the second coupler is positioned for selectively attaching to the first coupler for removably securing the screen to the frame, the second coupler and the first coupler comprising a hook and loop strap.

* * * * *